US010056692B2

(12) United States Patent
Werner et al.

(10) Patent No.: US 10,056,692 B2
(45) Date of Patent: Aug. 21, 2018

(54) ANTENNA APPARATUS AND COMMUNICATION SYSTEM

(71) Applicant: The Penn State Research Foundation, University Park, PA (US)

(72) Inventors: Douglas H. Werner, State College, PA (US); Zhihao Jiang, State College, PA (US)

(73) Assignee: The Penn State Research Foundation, University Park, PA (US)

( * ) Notice: Subject to any disclaimer, the term of this patent is extended or adjusted under 35 U.S.C. 154(b) by 0 days.

(21) Appl. No.: 15/358,577

(22) Filed: Nov. 22, 2016

(65) Prior Publication Data

US 2017/0201026 A1 Jul. 13, 2017

Related U.S. Application Data

(60) Provisional application No. 62/278,043, filed on Jan. 13, 2016.

(51) Int. Cl.

| | |
|---|---|
| ***H01Q 1/48*** | (2006.01) |
| ***H01Q 9/04*** | (2006.01) |
| ***H01Q 1/22*** | (2006.01) |
| ***H01Q 9/40*** | (2006.01) |
| ***H01Q 15/00*** | (2006.01) |

(52) U.S. Cl.

CPC ..... *H01Q 9/0492* (2013.01); *H01Q 1/2258* (2013.01); *H01Q 1/48* (2013.01); *H01Q 9/40* (2013.01); *H01Q 15/0013* (2013.01)

(58) Field of Classification Search

CPC ..... H01Q 9/0492; H01Q 1/2258; H01Q 1/48; H01Q 9/40; H01Q 15/0013

USPC ..... 343/700 MS

See application file for complete search history.

(56) References Cited

U.S. PATENT DOCUMENTS

| | | | |
|---|---|---|---|
| 7,042,419 | B2 | 5/2006 | Werner et al. |
| 7,057,559 | B2 | 6/2006 | Werner et al. |
| 7,190,317 | B2 | 3/2007 | Werner et al. |
| 7,256,753 | B2 | 8/2007 | Werner et al. |

(Continued)

FOREIGN PATENT DOCUMENTS

| | | | |
|---|---|---|---|
| EP | 2355243 | A1 | 8/2011 |
| WO | 2011087452 | A1 | 7/2011 |
| WO | 2015026897 | A1 | 2/2015 |

OTHER PUBLICATIONS

International Search Report for PCT/US2016/063817 dated Mar. 16, 2017.

(Continued)

*Primary Examiner* — Andrea Lindgren Baltzell

(74) *Attorney, Agent, or Firm* — Buchanan Ingersoll & Rooney PC

(57) ABSTRACT

An antenna includes a first body having a ring monopole and a second body positioned below the first body. The second body can have a plurality of notched ring resonators. A spacer can be positioned between the first and second bodies. In some embodiments, the second body can define an artificial ground. In addition, the ring resonators can be arranged and configured to generate a 180° phase difference between polarized waves so that a radiated wave from the ring monopole and a reflected wave from the artificial ground have orthogonal polarizations and a 90° phase difference to form a circularly polarized radiated wave.

20 Claims, 16 Drawing Sheets

(56) References Cited

U.S. PATENT DOCUMENTS

| | | | | |
|---|---|---|---|---|
| 7,420,524 | B2 | 9/2008 | Werner et al. | |
| 8,624,787 | B2 | 1/2014 | Druyan et al. | |
| 8,912,973 | B2 | 12/2014 | Werner et al. | |
| 2002/0047804 | A1 | 4/2002 | Ghosh et al. | |
| 2011/0248890 | A1 | 10/2011 | Lee et al. | |
| 2012/0280872 | A1* | 11/2012 | Werner | H01Q 15/0053 343/753 |
| 2013/0268250 | A1 | 10/2013 | Werner et al. | |
| 2014/0104136 | A1 | 4/2014 | Werner et al. | |
| 2015/0054696 | A1* | 2/2015 | Werner | H01Q 1/273 343/718 |
| 2016/0036128 | A1 | 2/2016 | Werner et al. | |

OTHER PUBLICATIONS

Written Opinion of the International Searching Authority for PCT/US2016/063817 dated Mar. 16, 2017.

S. Zhu and R. Langley, Dual-band wearable textile antenna on an EBG substrate, IEEE Trans. Antennas Propagat. 57, 926 (2009).

Z. H. Jiang, D. E. Brocker, P.E. Sieber, and D.H. Werner, A compact low profile metasurface-enabled antenna for wearable medical body-area network devices, IEEE Trans. Antennas Propagat. 62, 4021 (2014).

C. Hertleer, H. Rogier, L. Vallozzi, and L. Van Langenhove, A textile antenna for off-body communication integrated into protective clothing for firefighters, IEEE Trans. Antennas Propagat. 57, 919 (2009).

E. K. Kaivanto, M. Berg, E. Salonen, and P. de Maagt, Wearable circularly polarized antenna for personal satellite communication and navigation, IEEE Trans. Antennas Propagat. 59, 4490 (2011).

* cited by examiner

ANTENNA APPARATUS AND COMMUNICATION SYSTEM

CROSS-REFERENCE TO RELATED APPLICATIONS

The present application claims priority to U.S. Provisional Patent Application No. 62/278,043, which was filed on Jan. 13, 2016.

STATEMENT REGARDING FEDERALLY SPONSORED RESEARCH

This invention was made with government support under Grant No. EEC1160483, awarded by the National Science Foundation. The Government has certain rights in the invention

FIELD OF INVENTION

The present invention relates to antennas and communication systems that may utilize one or more such antennas for facilitating communication between different electronic devices such as sensors, body monitoring devices, measuring devices, computers, or other communication devices. For example, in one exemplary embodiment a communication device may be configured to be worn by a person and may include one or more embodiments of the antenna to permit the device to form radio frequency links with other devices.

BACKGROUND OF THE INVENTION

An antenna can have properties that affect the overall performance of a body area network system or a component of such a system. For instance, wearable sensors' performance in communication of data can be affected by the antenna of that sensor used for transmission of data to one or more other devices. It can often be difficult to design an antenna to meet certain design constraints that can be associated with a person wearing such a device or having such a device in close proximity to a person's body. For instance, unreliable wireless links can result due to a person's body motion affecting the antenna's performance. As another example, a transmission null can occur due to an antenna being designed to be linearly polarized and causing a complete polarization mismatch which will degrade the reliability of a wireless radio frequency link.

SUMMARY OF THE INVENTION

An antenna for a communication device is provided. Embodiments of the antenna may be configured as a circularly polarized (CP) antenna. The antenna may have an axial ratio (AR), a gain, a return loss ($S_{11}$), and a front-to-back ratio (FB). Embodiments of the antenna may also have a radius of curvature ($R_a$). In some embodiments, the antenna may be configured to have a planar configuration or a fully planar configuration that has an $R_a$. In some embodiments, the antenna can be structured to be composed of different sections or portions that are separated by a spacer (e.g. a foam spacer) that is positioned between different sections or portions (e.g. two separate members such as two separate plates or bodies that are separated by a foam spacer positioned between those two members).

In some embodiments, the antenna can include a first body that is configured as a planar ring monopole as a top member and a second body that is configured as an anisotropic artificial ground plane as a bottom member. A spacer may be positioned between the first and second bodies. In some embodiments, the spacer may be a foam spacer. The second body may be comprised of an array of a finite number of metallic resonators (e.g. ring resonators) that is on a metallic sheet (e.g. a copper sheet). Each of the ring resonators can have a pair of diagonal corners that are configured to generate a 180° phase difference between the reflected waves polarized in the x+y and x−y directions. In some embodiments, the phase difference may be about a 180° phase shift (e.g. between 170°-190° phase shift or between a 175°-180° phase shift or between a 175°-185° phase shift). This phase difference can be configured to ensure that directly radiated waves from the first body monopole and the second body artificial ground have orthogonal polarizations and a 90° phase difference that results in a circularly polarized radiated wave. The circularly polarized radiated wave can be transmitted toward another antenna for the transmission of data along a radio frequency link defined between the two antennas.

Some embodiments of our antenna can include a first body having a ring monopole and a second body positioned below the first body. The second body can have a plurality of resonators (e.g. ring resonators). A spacer can be positioned between the first and second bodies.

The first body can have the ring monopole on or in a substrate and the resonators of the second body can each be ring resonators. The ring resonators can be arranged in a two by two matrix or two by two array in which those resonators are backed by a metallic sheet. A substrate (e.g. a dielectric substrate) can be positioned between the resonators and the metallic sheet. The substrate of the first body can be a dielectric substrate in some embodiments. In other embodiments a different type of array or matrix of resonators (e.g. ring resonators) can be utilized. For instance, it is contemplated that a 1×2, a 2×3, a 3×3, a 2×4, a 3×4, or a 4×4 array of ring resonators may be positioned in or on the second body in some embodiments.

Each of the ring resonators can have a particular type of annular configuration (e.g. polygonal shaped annular body, oval shaped annular body, circular shaped annular body, etc.). In some embodiments, the ring resonators can have opposite angled sides. Each of the opposite angled sides can have a notch defined therein that is in communication with an inner central opening defined by the ring resonator.

In some embodiments, the second body can define an anisotropic artificial ground based on its composition and structure. In such embodiments, the ring resonators can be arranged and configured to generate a 180° phase difference between polarized reflected waves so that a radiated wave from the ring monopole and a reflected wave from the anisotropic artificial ground have orthogonal polarizations and a 90° phase difference to form a circularly polarized radiated wave.

In some embodiments of the antenna, the second body can define an artificial ground and the resonators (e.g. ring resonators) can be arranged and configured to generate a 180° phase difference between polarized waves so that a radiated wave from the ring monopole and a reflected wave from the artificial ground have orthogonal polarizations and a 90° phase difference to form a circularly polarized radiated wave.

In some embodiments, the antenna can be configured to have a relatively small footprint. For instance, in some embodiments, the entire footprint of the antenna can be 50 mm long by 50 mm wide and have a 6 mm thickness. In some embodiments, the antenna may also be configured to have a radius of curvature that is between 50 mm and 100 mm.

Embodiments of our communication device can include at least one embodiment of our antenna. For instance, a communication device can include a processor connected to non-transitory memory and a transceiver unit that is connected to an embodiment of our antenna. The antenna can include, for example, a first body having a ring monopole and a second body positioned below the first body that has a plurality of ring resonators. The antenna can also comprise a spacer positioned between the first and second bodies. In some embodiments, the first body can have the ring monopole in or on a substrate and the resonators of the second body can be ring resonators that are arranged in a two by two matrix or two by two array that are backed by a metallic sheet. A dielectric substrate may be between the resonators and the metallic sheet. The ring resonators may have any of a number of different annular shaped structures (e.g. polygonal, circular, oval, triangular, hexagonal, rectangular, etc.).

An embodiment of our communication system can include a communication device having an antenna that is communicatively connectable to at least one of a node and a computer device via a radio link established via the antenna of the communication device. The antenna may be an embodiment of our antenna disclosed herein. For instance, the antenna may include a first body having a ring monopole, a second body positioned below the first body that has a plurality of ring resonators, and a spacer positioned between the first and second bodies. The second body can define an artificial ground and the ring resonators can be arranged and configured to generate a 180° phase difference between polarized waves so that a radiated wave from the ring monopole and a reflected wave from the artificial ground have orthogonal polarizations and a 90° phase difference to form a circularly polarized radiated wave. The ring resonators can be backed by a metallic sheet and the artificial ground can be configured as an anisotropic artificial ground.

Other details, objects, and advantages of the invention will become apparent as the following description of certain present preferred embodiments thereof and certain present preferred methods of practicing the same proceeds.

BRIEF DESCRIPTION OF THE DRAWINGS

Exemplary embodiments of our antenna, systems and devices that utilize one or more embodiments of our antenna, and methods of making and using the same are shown in the accompanying drawings. It should be appreciated that like reference numbers used in the drawings may identify like components.

DETAILED DESCRIPTION OF PRESENT PREFERRED EMBODIMENTS

Figure 1:
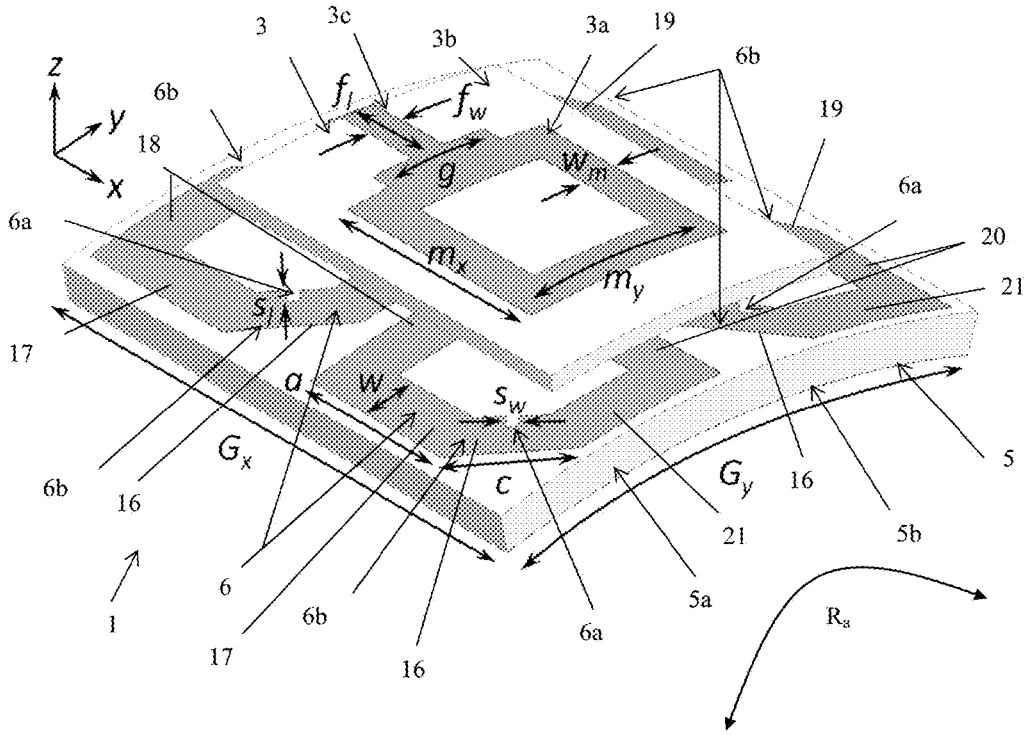
FIG. 1 is a perspective view of a first exemplary embodiment of our antenna that is utilizable in one or more devices of a communication system.
Figure 2:
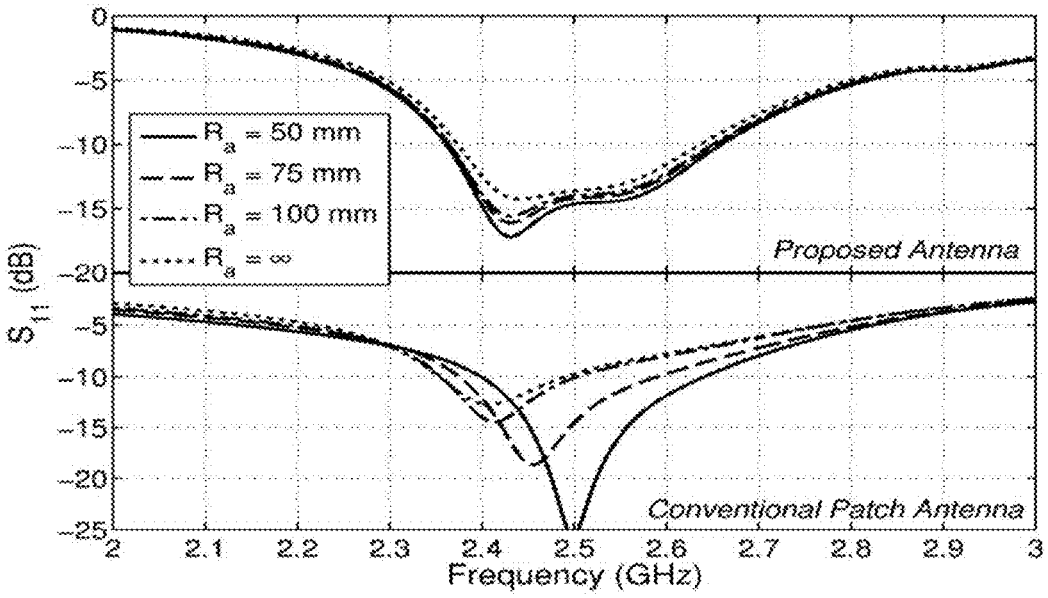
FIG. 2 is a graph illustrating a simulated $S_{11}$ of embodiments of our antenna and a conventional CP patch antenna having different values of $R_a$.
Figure 3:
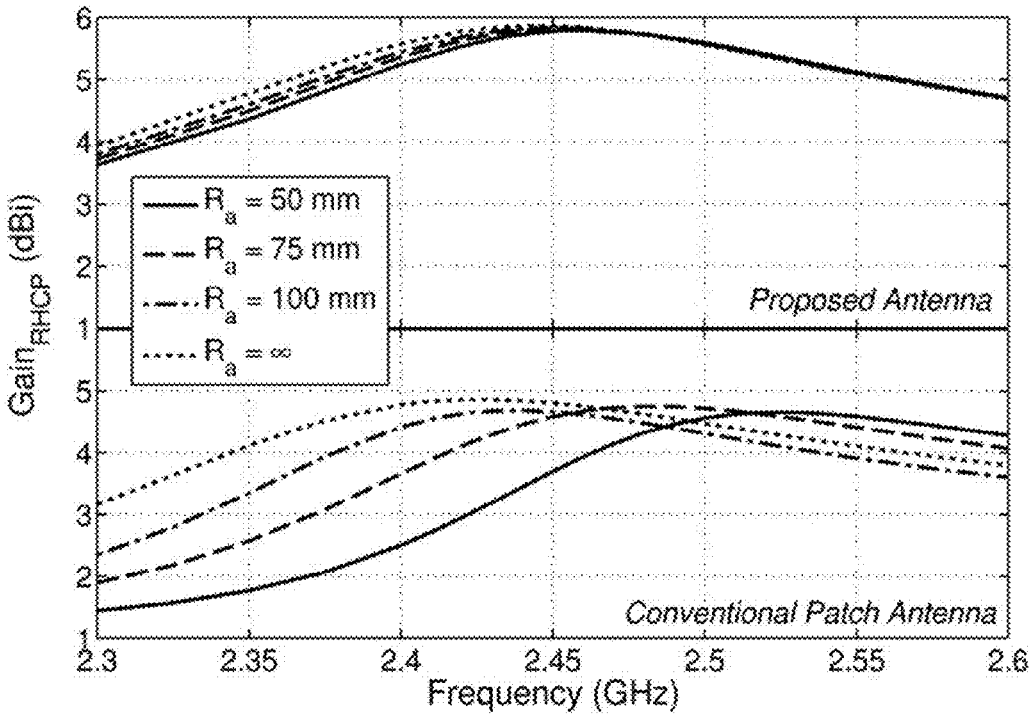
FIG. 3 is a graph illustrating a simulated gain of an embodiment of our antenna and a conventional CP patch antenna having different values of $R_a$.
Figure 4:
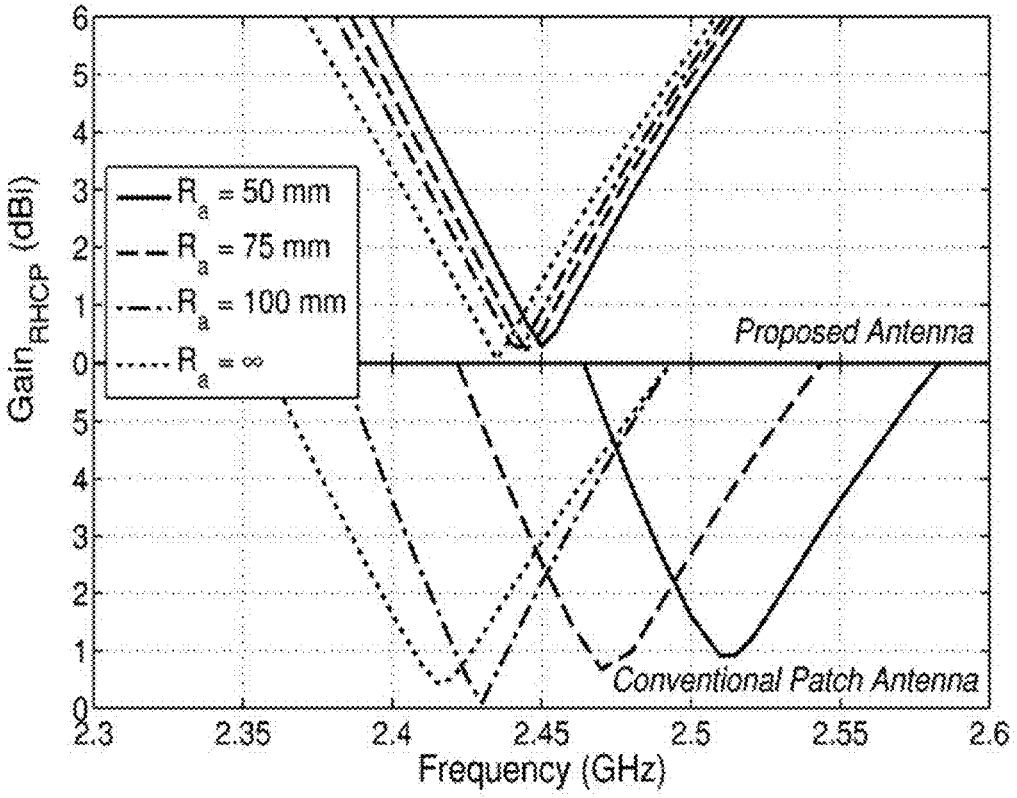
FIG. 4 is a graph illustrating a simulated AR of an embodiment of our antenna and a conventional CP patch antenna having different values of $R_a$.
Figure 5:
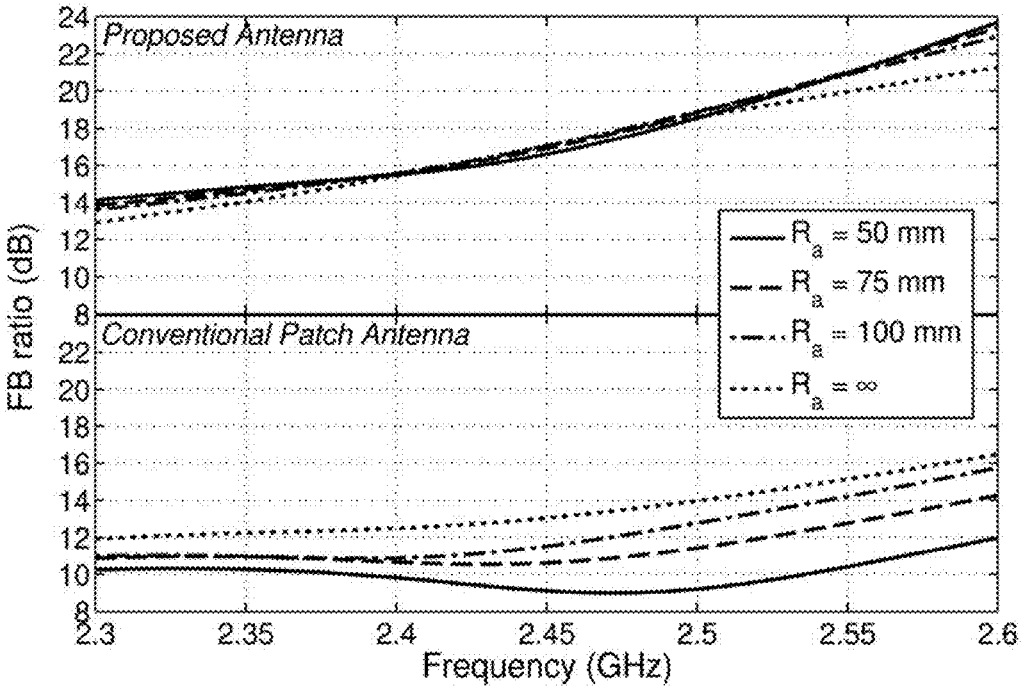
FIG. 5 is a graph illustrating a simulated FB ratio of an embodiment of our antenna and a conventional CP patch antenna having different values of $R_a$.
Figure 10:
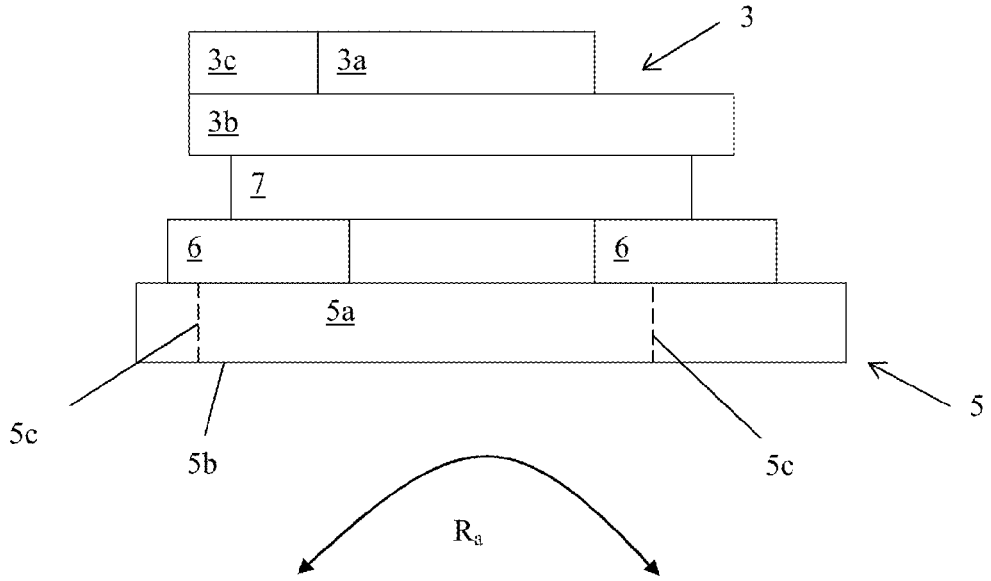
FIG. 10 is a schematic block diagram of a side view of the first exemplary embodiment of our antenna.
Figure 11:
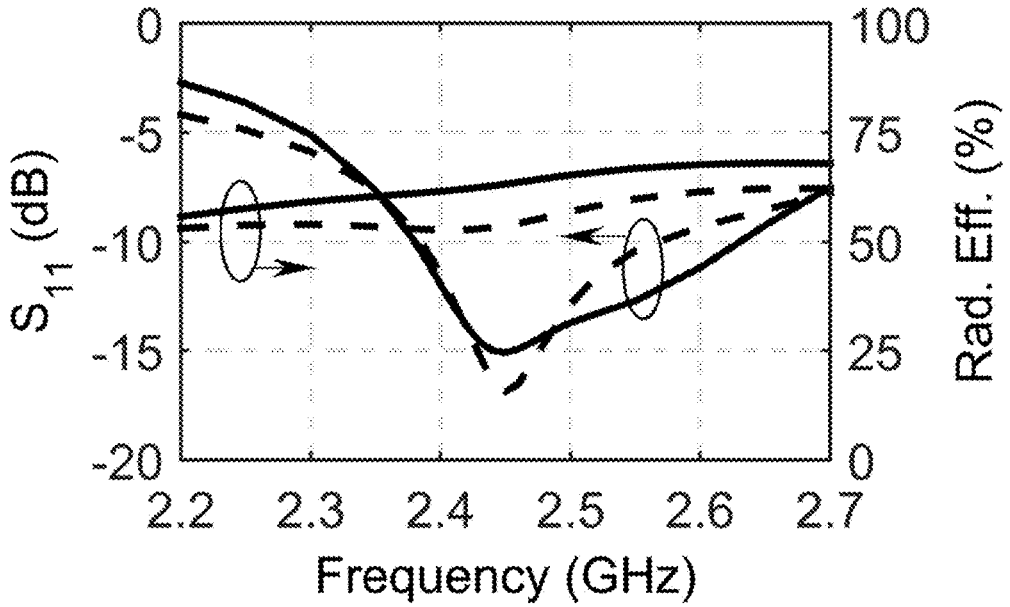
FIG. 11 is a graph illustrating simulation results for $S_{11}$ and radiation efficiency (Rad. Eff.) of an embodiment of our antenna mounted on the center of a chest of a user (results indicated by solid line) compared to a conventional CP patch antenna (results indicated by broken line) mounted on the center of a chest of a user.
Figure 12:
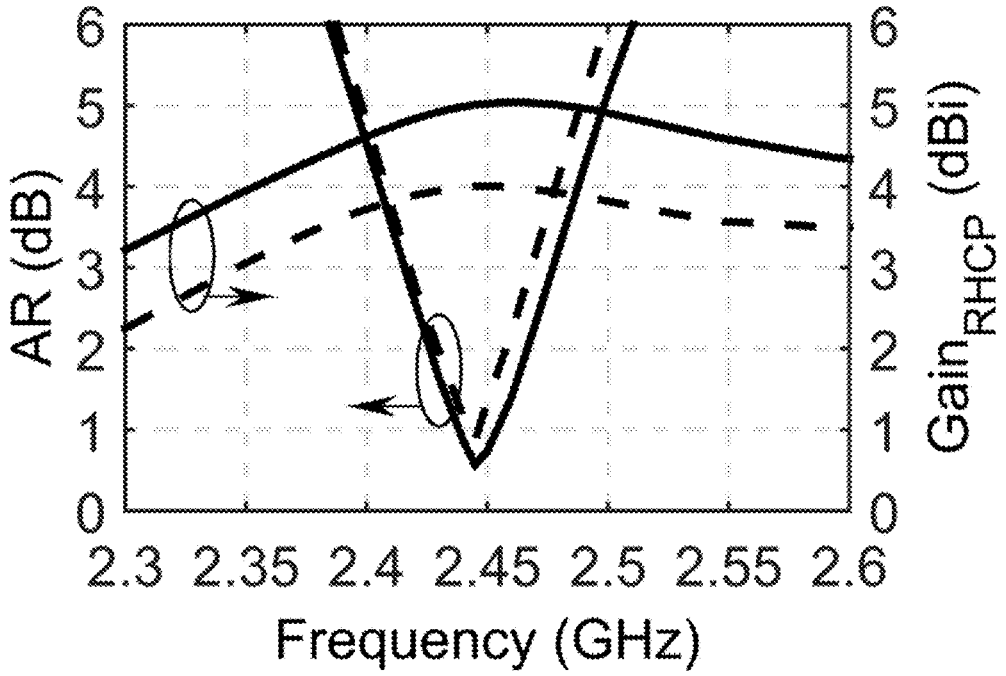
FIG. 12 is a graph illustrating simulation results for the broadside AR and gain of an embodiment of our antenna mounted on the center of a chest of a user (results indicated by solid line) compared to a conventional CP patch antenna mounted on the center of a chest of a user (results indicated by broken line).
Figure 13:
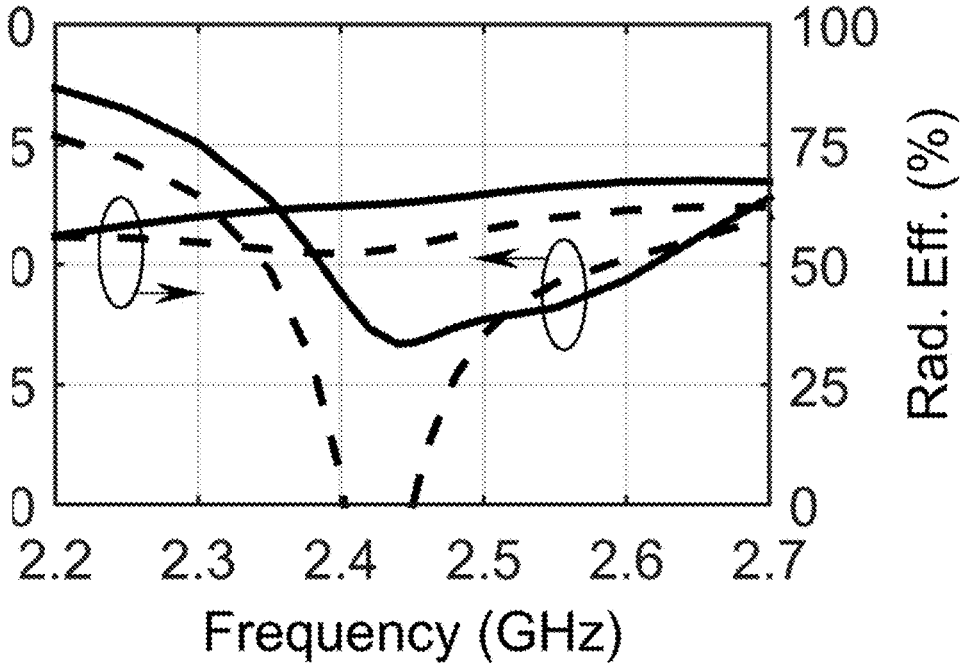
FIG. 13 is a graph illustrating simulation results for $S_{11}$ and radiation efficiency (Rad. Eff) of an embodiment of our antenna mounted on the shoulder of a user (results indicated by solid line) compared to a conventional CP patch antenna mounted in the center on the shoulder of a user (results indicated by broken line).
Figure 14:
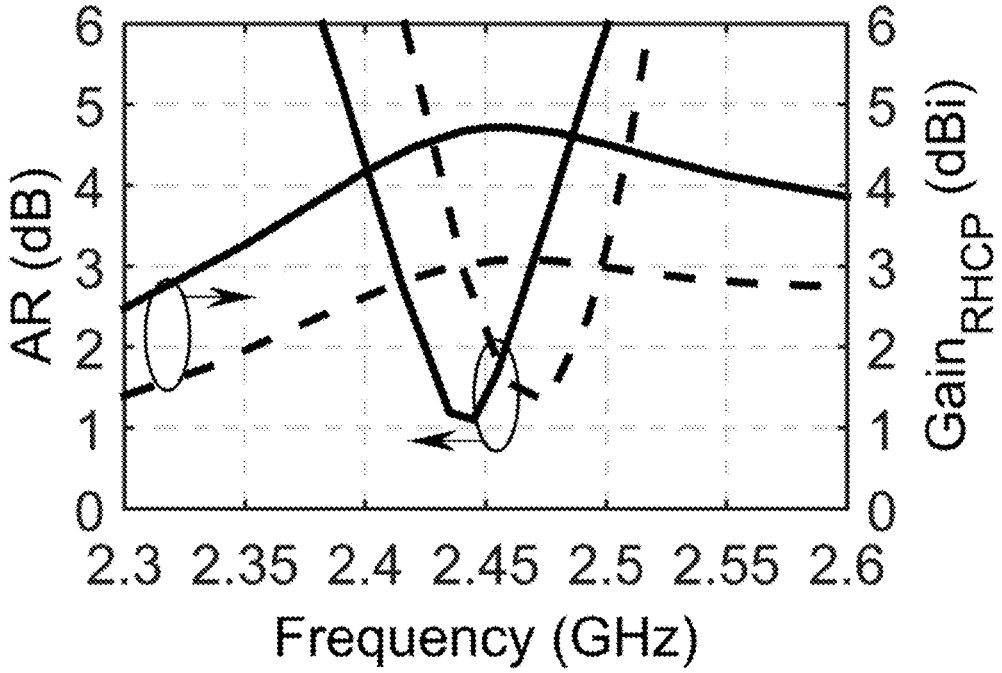
FIG. 14 is a graph illustrating simulation results for the broadside AR and gain of an embodiment of our antenna mounted on the shoulder of a user (results indicated by solid line) compared to a conventional CP patch antenna mounted on the shoulder of a user (results indicated by broken line).
Figure 15:
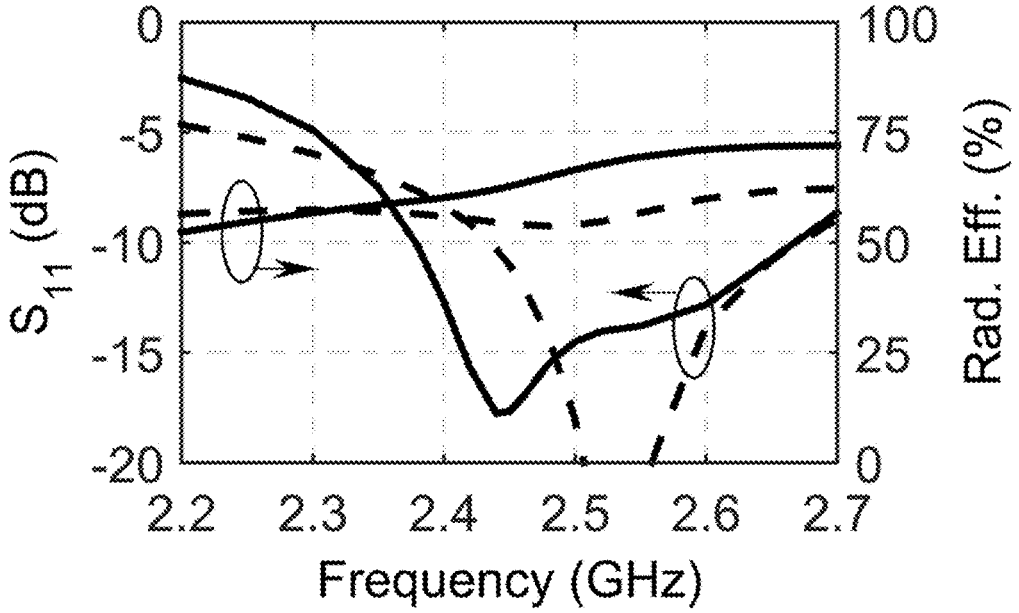
FIG. 15 is a graph illustrating simulation results for $S_{11}$ and radiation efficiency (Rad. Eff) of an embodiment of our antenna mounted on the wrist of a user (results indicated by solid line) compared to a conventional CP patch antenna mounted in the center on the wrist of a user (results indicated by broken line).
Figure 16:
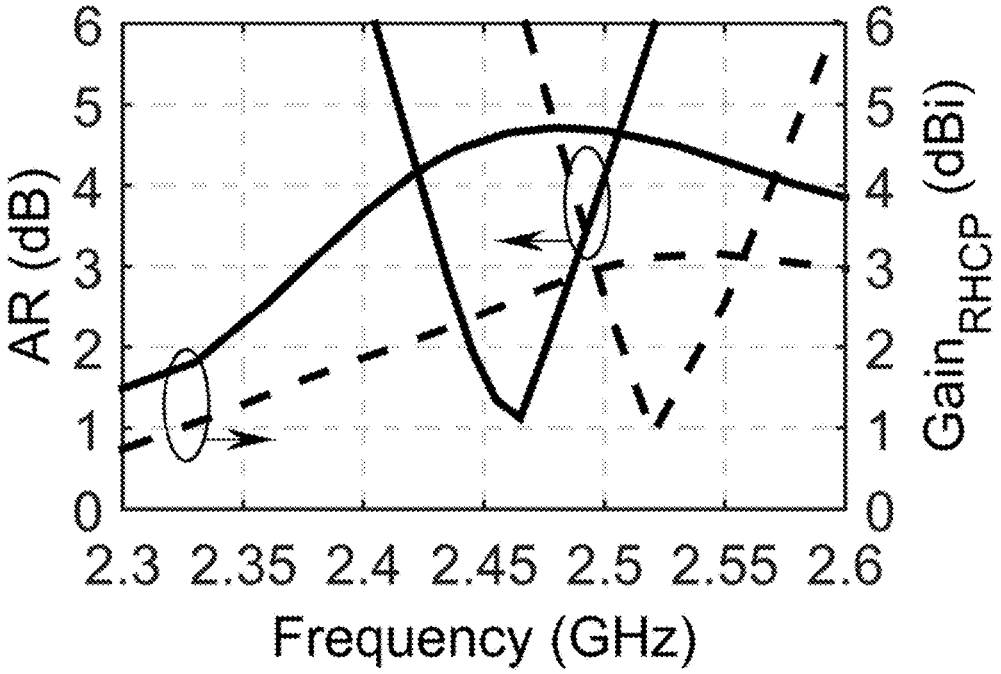
FIG. 16 is a graph illustrating simulation results for the broadside AR and gain of an embodiment of our antenna mounted on the wrist of a user (results indicated by solid line) compared to a conventional CP patch antenna mounted on the wrist of a user (results indicated by broken line).

We have determined that a fully planar configuration can be adopted for a metamaterial-enabled CP antenna design, which has a radius of curvature of $R_a$. Referring to FIGS. 1 and 10, an embodiment of the antenna 1 can include two sections separated by a relatively thin foam spacer 7—a planar ring monopole configured as a top member 3 and an anisotropic artificial ground plane configured as a bottom member 5. The ring monopole can have any type of ring shape for different embodiments. (e.g. a circular shaped structure with a circular shaped inner opening, a polygonal shaped structure having an inner central opening having a circular or polygonal shape, etc.).

In some embodiments, the spacer 7 can be composed of other materials instead of foam. For example, the spacer 7 can be composed of a dielectric material (e.g. a non-foam dielectric material).

In some embodiments, the artificial ground plane can be a bottom member 5 that consists of a two by two array of ring resonators backed by a metallic sheet. Each of the ring resonators has a pair of diagonal corners cut in order to generate about a 180° phase difference between the reflected waves polarized in the x+y and x−y directions. This can allow a directly radiated wave from the top member that is configured as a monopole and the reflected wave from the bottom member 5 that is configured as an artificial ground to have orthogonal polarizations and a 90° phase difference that defines a circularly polarized radiated waves for the transmission of data along a radio frequency link and/or the receipt of data along that radio frequency link. It should be appreciated that the circularly polarized radiated wave that can be formed by the antenna can be transmitted toward another antenna of another device for the transmission of data along a radio frequency link defined between those antennas.

In other embodiments, the array of resonators (e.g. ring resonators or other type of resonators) positioned on or in the second body can have different configurations. For instance, the resonators may be positioned in a 1×2, 2×3, 3×3, 3×4, or 4×4 array of resonators (e.g. ring resonators or other resonators). As yet another example, the array of resonators may be positioned in the second body and backed by a metallic sheet via a dielectric substrate positioned between the resonators (e.g. ring resonators) and the metallic sheet in a 3×2, 4×3, or 2×1 array or other type of array or matrix.

The top member 3 can be configured to include a conductor body 3*a* that is positioned on or within a substrate 3*b* to help define the monopole of the top member 3. The substrate 3*b* can be composed of a dielectric material. The conductor body can be configured to have a ring, which may be an annular shaped structure (e.g. a curved annular ring or a polygonal shaped annular structure such as an annular rectangular structure, an annular square structure, an annular triangular structure or an annular hexagonal structure).

In some embodiments, the ring conductor body can include a first side having a first end and a second end. The ring conductor body can also include a second side and a third side and a fourth side. The second side can extend from the first end of the first side to a first end of the fourth side and the third side can extend form the second end of the first side to the second end of the fourth side. The second and third sides can have a length $m_x$ and a width $w_m$. The fourth side can extend from its first end to its second end along a distance $m_y$ and the first side can extend from its first end to its second end along a distance g. An annular space (e.g. a circular shaped opening, a rectangular shaped opening, etc.) can be defined between the first, second, third and fourth sides.

The annular space can be defined in any number of shapes (e.g. elliptical, polygonal, circular, rectangular, square, etc.). In some embodiments, the conductor body can have other configurations to define a different type of ring conductor body structure.

The top member can also include a microstrip feed line 3*c* that extends from the conductor body 3*a* to a side of the top member. The feed line 3*c* can be configured to have a width $f_w$ and can extend along its length $f_l$ from its first end to a second end (e.g. from the first side of the conductor body 3*a* to a side of the top member 3. For some embodiments, the feed line can be a microstrip feed line that is configured to maintain a 50 ohm (Ω) characteristic impedance. In some embodiments, the shape and structure of the first side of the conductor body that extends about distance g and/or the feed line 3*c* can be configured to control impedance matching of the integrated antenna.

The bottom member 5 can have a plurality of resonators 6 that are attached to or adjacent to a metallic sheet 5*b*. Each resonator 6 may be a ring resonator (e.g. a resonator having an annular structure such as a polygonal shaped annular structure or a circular shaped annular structure). In some embodiments, the resonators 6 may be irregularly shaped, elliptical shaped, hexagonally shaped, rectangular shaped, or have another type of shape. In some embodiments, the resonators 6 may each be planar resonators.

For example, in some embodiments, each of the resonators 6 may have a plurality of interconnected sides that define an annular shaped structure having a central hole or opening. Each side may have a width W. The sides may also include two angled opposed sides that each includes a notch 6*a* that has a mouth that is in communication with the central opening. These angled opposed sides may have a length c.

For instance, each resonator 6 can have a first angled side 16 that has a length c, a second linearly extending side 17 that extends along a length a from its first end that is at the first end of the first angled side 16 to its second end, a third linearly extending side 18 that extends along a length a from its first end at the second end of the second linearly extending side 17 to a first end of a fourth linearly extending side 19. The fourth linearly extending side may extend along a length c linearly at an angle from its first end to its second end at which it may be integral to a first end of a fifth linearly extending side 20, which can extend along a length a from its first end to its second end. A sixth linearly extending side 21 can extend along a length a from the second end of the fifth linearly extending side 20 to the second end of the first linearly extending side 16 to define the central opening of the resonator. The first and fourth linearly extending sides 16 and 19 may be parallel to each other and be on opposite sides of the resonator (e.g. define opposite sides of the resonator 6). Each of these sides may have a notch 6*a* that is in communication with the central opening. The width of each of the linearly extending sides may have the width w. The length of the first and fourth linearly extending sides 16 and 19 may have the same length, length c and be parallel to each other. The length of the second, third, fifth, and sixth linearly extending sides 17, 18, 20, and 21 may have the same length a. The second and fifth sides 17 and 20 may be on opposite sides of the resonator 6 (e.g. define opposite sides of the resonator 6) and be parallel to each other. The third and sixth sides 18 and 21 may be on opposite sides of the resonator 6 (e.g. define opposite sides of the resonator 6) and be parallel to each other.

One or more vias 5*c* can extend between each of the resonators 6 and the metallic sheet 5*b* of the bottom member to connect at least one resonator to the metallic sheet 5*b*. In such embodiments, the vias 5*c* may be used to facilitate the connection between the resonators 6 and the metallic sheet 5*b*.

As noted herein, each of the resonators 6 can define notches 6*a*. Each notch 6*a* can have a width $s_w$ and length $s_l$ that is defined in angled corners 6*b* (e.g. notches 6*a* defined in the first and fourth sides 16 and 19) that are on opposite sides of the resonators 6. A mouth of each notch 6*a* can be in communication with the inner central opening of the annularly structured resonator 6.

A substrate 5*a* may be positioned between the metallic sheet 5*b* and the resonators 6. The substrate 5*a* can be composed of a dielectric material. The radius of curvature $R_a$ can be imposed from flexing the top member 3, bottom member 5, and the spacer 7 along the Y direction to a pre-selected amount so that it has a particular radius of curvature (e.g. a curvature of 50 mm, 75 mm, or 100 mm in they direction shown in FIG. 1).

We have determined that embodiments of our antenna can provide a highly efficient, compact and low profile CP antenna for the 2.4 GHz industrial, scientific and medical radio frequency band (also referred to as the ISM band). Embodiments of the antenna can be structured so that the antenna's entire footprint is only 50 mm by 50 mm, (i.e. $0.41\lambda_0$ by $0.41\lambda_0$) in the x and y directions as indicated in FIG. 1, while the total thickness in the Z direction as indicated in FIG. 1 is 6 mm, i.e. $0.049\lambda_0$ ($\lambda$ is a wavelength determined by $\lambda=c/f$, where c is the phase speed of the wave and f is the frequency of the wave and $\lambda_0$ is the light of wavelength). Such properties can be achieved by tuning the geometrical dimensions of both the top and bottom members 3 and 5 (e.g. the monopole and the artificial ground), as well as the spacing between them (e.g. size and configuration of the spacer 7) to allow for the operation of such an antenna in close proximity to the metasurface as well as providing a considerable reduction in its size to nearly the same as the antenna element without degrading the input impedance match or decreasing the front-to-back ratio.

The performance of an embodiment of our antenna, including the $S_{11}$, gain, axial ratio (AR), and front-to-back ratio (FB), are displayed in FIG. 2 through FIG. 5 for different values of Ra. As a reference, a conventional CP patch antenna with the same form factor is also shown in these Figures. For the simulation results shown in FIGS. 2-5, the embodiment of the antenna being evaluated had a substrate having a typical dielectric constant of polydimethylsiloxane (PDMS), which is 2.8 with a loss tangent of 0.02, and the conductivity of a silver nanowire composite, which is around 813000 siemens per meter (S/m). It should be noted that other flexible substrate materials, such as, but not limited to polyimide, fabrics, and textiles, can also be used instead of PDMS for substrates used in other embodiments. In terms of the conductor, silver inks, copper or any other suitably conductive materials can be alternative candidates.

For the simulations that were performed as shown in FIGS. 2-5, the different dimensions of the embodiment of the antenna being simulated were as follows: $G_x$=50 mm, $G_y$=50 mm, a=15 mm, c=11.6 mm, w=5 mm, $s_w$=1.5 mm, $s_l$=50 mm, $s_x$=1.7 mm, $m_x$=21 mm, $m_y$=21 mm, $w_m$=4 mm, g=12 mm, $f_w$=3.5 mm, and $f_l$=8 mm. For FIGS. 2-5, the term "Proposed Antenna" identifies this particular embodiment of the antenna and the term "Conventional Patch Antenna" identifies the conventional reference antenna used in the simulations. The "Conventional Patch Antenna" contained a simple patch radiator with a pair of truncated corners to support circularly-polarized radiated waves.

Referring to FIGS. 2-5, it can be seen that under different degrees of structural deformation, embodiments of our antenna can maintain a very robust performance. For example, an embodiment of the antenna can achieve a very good impedance matching within the ISM frequency range, i.e. S11<−13 decibels (dB) from 2.4 to 2.6 Gigahertz (GHz). At broadside, an embodiment of the antenna can have a gain of around 5.8 Decibel over anisotropic radiator (dBi) with an AR<3 dB bandwidth of about 70 Megahertz (MHz). Hence, the radiation efficiency of the proposed antenna is about 75-80%. Embodiments of our antenna can have an FB of around 17 dB. In contrast, the conventional CP patch antenna experiences a much more severe variation as the radius of curvature changes. The most apparent disadvantage is the frequency shift. After bending a flat CP patch antenna to conform to parts of a human body with a radius of 50 mm, which can be a typical value for a human arm, there is no overlapping band for the AR<3 dB. In addition, the gain of the CP patch antenna is about 1 dB smaller than that of the proposed antenna, indicating a significant radiation efficiency drop of about 20%. The FB ratio of the conventional CP patch antenna also degrades significantly as it is bent, which can make it unusable for wearable applications.

Figure 6:
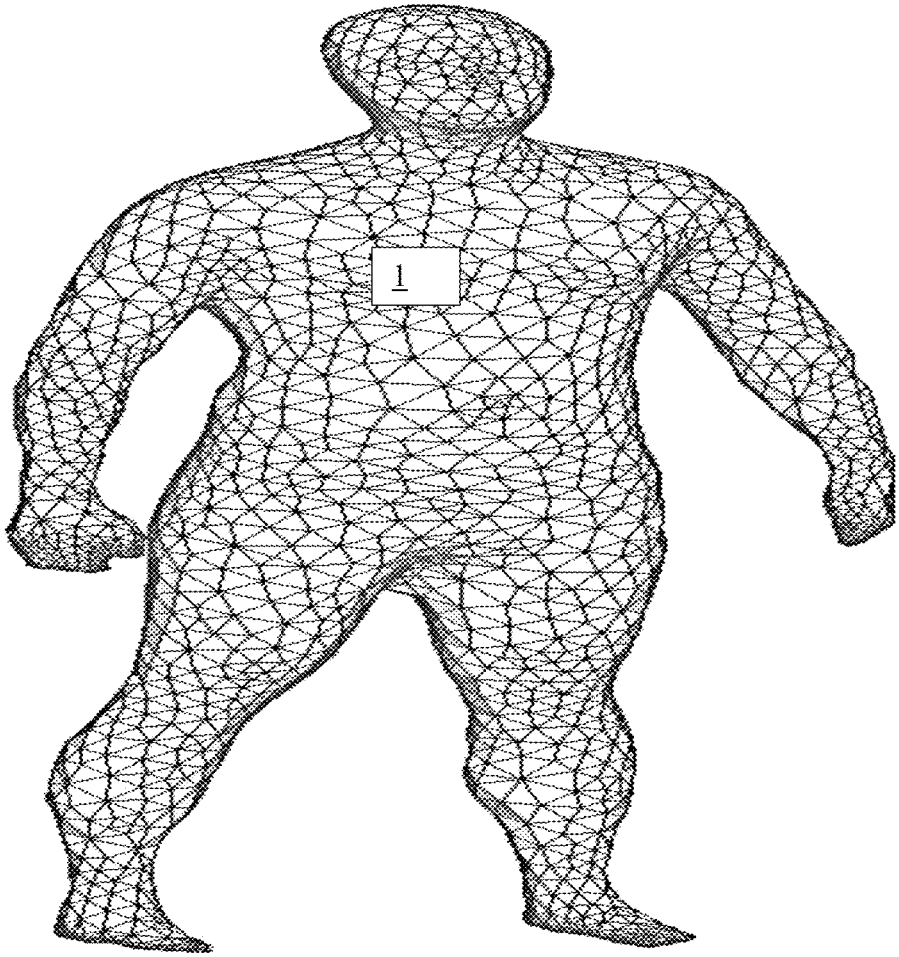
FIG. 6 is a schematic illustration of an exemplary embodiment of a communication device having an embodiment of our antenna that is worn by a person.
Figure 7:
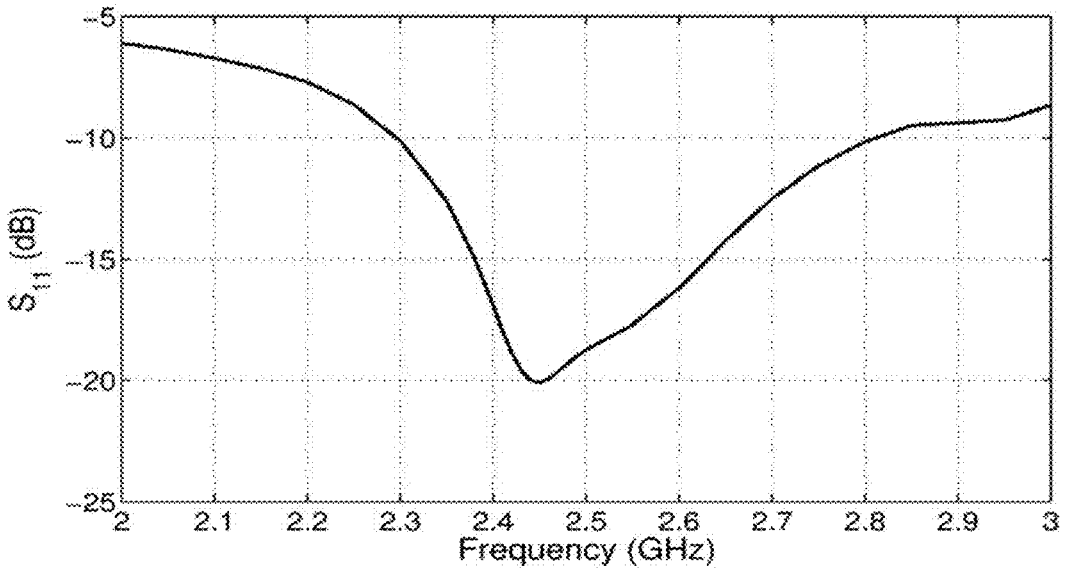
FIG. 7 is a graph illustrating a simulated $S_{11}$ of an embodiment of our antenna mounted on the right chest of a human body.
Figure 8:
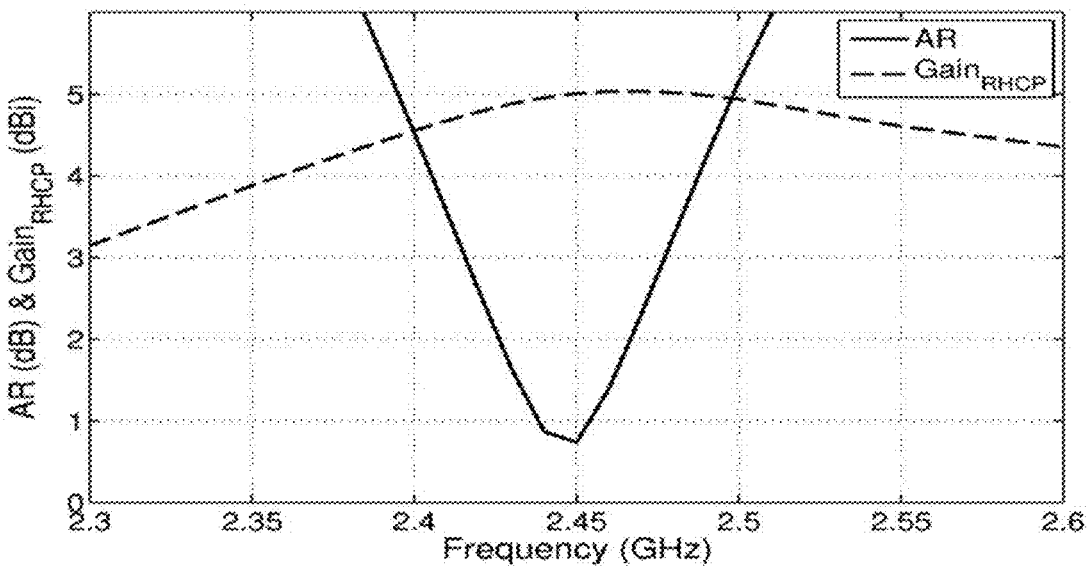
FIG. 8 is a graph illustrating simulated AR and gain of the embodiment of our antenna mounted on the right chest of a human body.

To further evaluate the performance of embodiments of our antenna for wearable applications, simulations were performed with an embodiment of our antenna on a human body. As shown in FIG. 6, the simulations were performed based on modeling designed to evaluate an embodiment of our antenna being mounted on the right-hand side of the chest on a human body mode (e.g. directly adhered adjacent to a person's chest or positioned over a location on a person's chest via another mechanism for mounting the device in that location). A homogenous full-scale human body model was employed in the simulations that were performed, the results of which are shown in FIGS. 7-8. The permittivity of the homogeneous human body model was chosen to be two-thirds of the permittivity of human muscle.

It can be seen from FIGS. 7 and 8 that the performance is well maintained for the embodiment of our antenna. The gain only drops by ~0.8 dB, indicating that the radiation efficiency of the antenna is still higher than 60%, which is far superior to many conventional antennas. With its CP radiation and robust electromagnetic properties, embodiments of our antenna can be incorporated into wearable devices that may be worn by a human for purposes of communicating various data (e.g. human body monitoring devices, sensors for measuring one or more health parameters of a human patient in a medical setting, etc.)

Referring to FIGS. 11-16, an embodiment of our integrated CP wearable antenna was also simulated when placed in different locations on a human body—on the chest, on the shoulder, and on the wrist. A permittivity value equal to ⅔ of that of muscle was assigned to the homogeneous human body model, as is commonly practice in the literature. As can be seen from FIGS. 11-16 in which the results for the conventional patch antenna are illustrated in broken line and the results for the embodiment of our antenna is shown in solid line, embodiments of our antenna can exhibit a very robust performance when placed in close proximity to human tissue, resulting in $S_{11}$, axial ratio (AR), and gain values which remain nearly unchanged. In comparison, a conventional CP patch antenna was also placed at the three positions on the human body model. It can be seen that it was found to have a lower radiation efficiency, a lower gain, and a significant AR band shift as compared to the simulated embodiment of our antenna.

Figure 9:
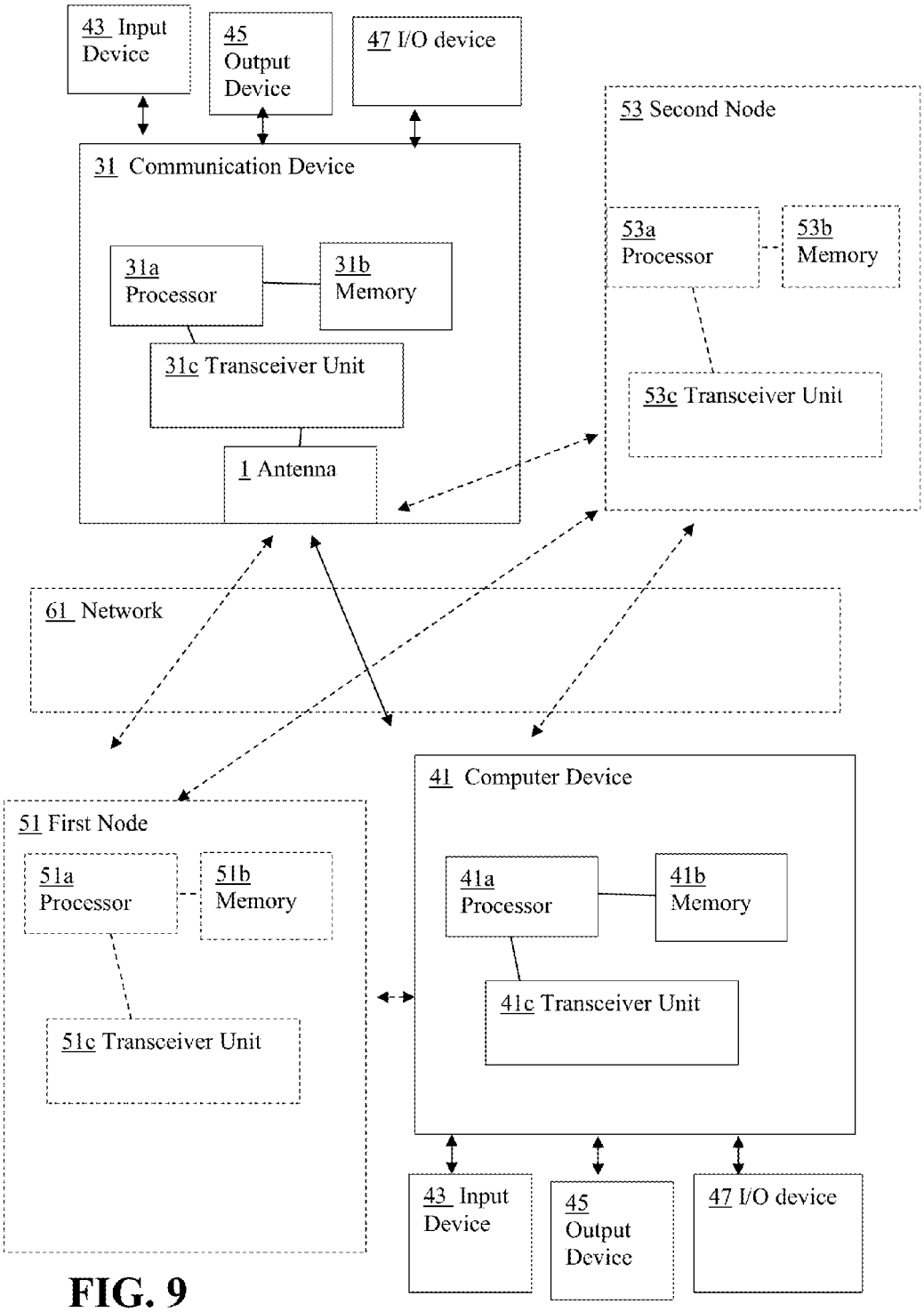
FIG. 9 is a block diagram illustrating an embodiment of a communication system that may utilize embodiments of the communication device that each has one or more embodiments of our antenna.

Referring to FIG. 9, an exemplary embodiment of a communication system that may have one or more devices utilize an embodiment of our antenna 1 is shown. For instance, one or more communication devices 31 may have one or more such antennas 1. The communication device 31 can be configured as a measurement device, a detector, a sensor, or other type of device. The communication device 31 may be configured to be worn by a person or to be mounted onto a person. The communication device can include hardware, such as a processor 31*a* that is communicatively connected to non-transitory memory 31*b* and a transceiver unit 31*c*. The transceiver unit 31*c* may be connected to the antenna 1. The processor 31*a* may be a central processing unit (CPU) or other type of hardware processor and the memory 31*b* may be flash memory, a hard drive, or other type of non-transitory memory. One or more input devices 43 and/or output devices 45 and/or input/output (I/O) devices 47 may be connected to the communication device 31 as well. For instance, a printer, a touch screen display, a monitor, a pointer device, a keyboard, or other type of input and/or output device may be connected to the communication device 31.

The communication device 31 may have a communication connection established with a computer device 41 that includes a wireless radio frequency link via the antenna 1. The radio frequency link may be a local link that is a result of the communication device 31 being within a certain physical distance of the computer device 41 (e.g. a Bluetooth link or a near field communication link, etc.). The computer device 41 may be configured as a server, a workstation, an electronic tablet, a laptop computer, a personal computer, or other type of electronic computer device that includes a processor 41*a*, non-transitory memory 41*b* and a transceiver unit 41*c* and may also include other hardware components. The processor may be a central processing unit (CPU) or other type of hardware processor and the memory may be flash memory, a hard drive, or other type of non-transitory memory. One or more input devices 43 and/or output devices 45 and/or input/output (I/O) devices 47 may be connected to the computer device 41 as well. For instance, a printer, a touch screen display, a pointer device (e.g. a mouse or stylus), a keyboard, a monitor, or other type of input and/or output device may be connected to the computer device 41.

In other embodiments, the link may be part of a communication connection that is established via a network connection that is facilitated by one or more intermediate devices, such as a first node 51 and/or a second node 53 that may be connected to a network 61 (e.g. the internet, a local area network, a wide area network, etc.). Each node may include a processor 51*a*, 53*a* that is connected to non-transitory memory 51*b*, 53*b* and a transceiver unit 51*c*, 53*c*. In some embodiments, each node may be an access point, a router, a base station, a server, or other type of communication device that may be within network 61 or connected to the network 61.

In some embodiments, the communication device 31 may be configured to utilize its antenna 1 to form a wireless link with a first node 51 or a second node 53 for facilitating communications to the computer device 41 or with the computer device 41. The first node 51 or second node 53 may then pass the data received from such a link to other devices via the network along a communication route that defines the communication connection between the computer device 41 and the communication device 31. The data that may be transmitted to the computer device 41 from the communication device 31 can include measurement data or other data collected by one or more sensors of the communication device 31. The computer device 41 can be configured to receive and store that data. The computer device 41 can also be configured to transmit data to the communication device 31, which may include instructions that are utilizable for controlling one or more sensors of that communication device 31 or other operation of the communication device 31.

In some embodiments, the communication system that includes the computer device 41 and one or more communication devices 31 may be utilized in a hospital or other type of medical care facility. For instance, communication devices 31 may be worn by patients of a hospital, long-term care facility, elderly care facility, or other type of health care related facility for communicating with one or more computer devices 41. The computer devices 41 may monitor one or more health parameters of patients via communications with the communication devices 31 that may occur wirelessly via a local area wireless network of the facility.

While certain present preferred exemplary embodiments of our antenna and communication systems, and exemplary embodiments of methods for making and using the same have been shown and described above, it is to be distinctly understood that the invention is not limited thereto but may be otherwise variously embodied and practiced within the scope of the following claims.

We claim:

1. An antenna comprising:

a first body having a ring monopole;

a second body positioned below the first body, the second body having a plurality of resonators, the second body defining an artificial ground; and a spacer positioned between the first body and the second body;

wherein the resonators are arranged and configured to generate a 180° phase difference between polarized waves so that a radiated wave from the ring monopole and a reflected wave from the artificial ground have orthogonal polarizations and a 90° phase difference to form a circularly polarized radiated wave.

2. The antenna of claim 1, wherein the first body has the ring monopole on or in a substrate and the resonators of the second body are ring resonators that are arranged in a two by two array, and wherein the ring resonators are backed by a metallic sheet.

3. The antenna of claim 1, wherein the resonators are backed by a metallic sheet.

4. The antenna of claim 1, wherein each of the resonators is a ring resonator having opposite angled sides, each of the opposite angled sides having a notch defined therein.

5. The antenna of claim 4, wherein the second body defines an anisotropic artificial ground.

6. The antenna of claim 5, wherein the first body has the ring monopole on or in a substrate and the resonators of the second body are ring resonators that are arranged in a two by two array, and wherein the ring resonators are backed by a metallic sheet.

7. The antenna of claim 1, wherein the first body has a feed line that is configured to maintain a 50 ohm characteristic impedance that extends from a first side of the ring monopole, the ring monopole having a second side and a third side connected to the first side and a fourth side connected to the third side and the second side to define a central opening; and each of the resonators defining a central opening, each of the resonators having a first side, a second side that extends linearly from the first side, a third side that extends linearly from the second side, a fourth side that extends linearly from the second side to a fifth side, the fifth side extending linearly from the fourth side to a sixth side, the sixth side extending linearly from the fifth side to the first side, the fourth side being opposite and parallel to the first side, the first side having a notch defined therein and the fourth side having a notch defined therein, the notch of the first side and the notch of the fourth side being in communication with the central opening.

8. The antenna of claim 1, wherein an entire footprint of the antenna is 50 mm long by 50 mm wide and has a 6 mm thickness.

9. The antenna of claim 1, wherein the antenna is configured to have a radius of curvature that is between 50 mm and 100 mm.

10. A communication device, the communication device comprising:

a processor connected to non-transitory memory and a transceiver unit, the transceiver unit being connected to an antenna, the antenna comprising:

a first body having a ring monopole; and a second body positioned below the first body, the second body having a plurality of resonators;

wherein the resonators are arranged and configured to generate a 180° phase difference between polarized waves so that a radiated wave from the ring monopole and a reflected wave from a portion of the second body have orthogonal polarizations and a 90° phase difference to form a circularly polarized radiated wave.

11. The communication device of claim 10, wherein the antenna also comprises a spacer positioned between the first body and the second body; and wherein first body has a feed line that is configured to maintain a 50 ohm characteristic impedance that extends from a first side of the ring monopole, the ring monopole having a second side and a third side connected to the first side and a fourth side connected to the third side and the second side to define a central opening; and wherein each of the resonators define a central opening, each of the resonators having a first side, a second side that extends linearly from the first side, a third side that extends linearly from the second side, a fourth side that extends linearly from the second side to a fifth side, the fifth side extending linearly from the fourth side to a sixth side, the sixth side extending linearly from the fifth side to the first side, the fourth side being opposite and parallel to the first side, the first side having a notch defined therein and the fourth side having a notch defined therein, the notch of the first side and the notch of the fourth side being in communication with the central opening.

12. The communication device of claim 11, wherein the first body has the ring monopole on or in a substrate and the resonators of the second body are ring resonators that are arranged in a two by two array, and wherein the ring resonators are backed by a metallic sheet.

13. The communication device of claim 11, wherein the resonators are ring resonators that are backed by a metallic sheet.

14. The communication device of claim 11, wherein each of the resonators is a ring resonator having opposite angled sides, each of the opposite angled sides having a notch defined therein.

15. The communication device of claim 14, wherein the second body defines an anisotropic artificial ground.

16. The communication device of claim 15, wherein the portion of the second body defines an artificial ground and the first body includes a microstrip feed line configured to maintain a 50 ohm characteristic impedance.

17. The communication device of claim 10, wherein the portion of the second body defines an artificial ground; and first body has a feed line that is configured to maintain a 50 ohm characteristic impedance that extends from a first side of the ring monopole, the ring monopole having a second side and a third side connected to the first side and a fourth side connected to the third side and the second side to define a central opening; and each of the resonators defining a central opening, each of the resonators having a first side, a second side that extends linearly from the first side, a third side that extends linearly from the second side, a fourth side that extends linearly from the second side to a fifth side, the fifth side extending linearly from the fourth side to a sixth side, the sixth side extending linearly from the fifth side to the first side, the fourth side being opposite and parallel to the first side, the first side having a notch defined therein and the fourth side having a notch defined therein, the notch of the first side and the notch of the fourth side being in communication with the central opening.

18. A communication system comprising:

a communication device having an antenna that is communicatively connectable to at least one of a node and a computer device via a radio link established via the antenna of the communication device, the antenna comprising:

a first body having a ring monopole;

a second body positioned below the first body, the second body having a plurality of ring resonators; and a spacer positioned between the first body and the second body;

wherein the resonators are arranged and configured to generate a 180° phase difference between polarized waves so that a radiated wave from the ring monopole and a reflected wave from a portion of the second body have orthogonal polarizations and a 90° phase difference to form a circularly polarized radiated wave.

19. The communication system of claim 18, wherein the portion of the second body defines an artificial ground and the first body includes a microstrip feed line configured to maintain a 50 ohm characteristic impedance first body has a feed line that is configured to maintain a 50 ohm characteristic impedance that extends from a first side of the ring monopole, the ring monopole having a second side and a third side connected to the first side and a fourth side connected to the third side and the second side to define a central opening; and each of the resonators defining a central opening, each of the resonators having a first side, a second side that extends linearly from the first side, a third side that extends linearly from the second side, a fourth side that extends linearly from the second side to a fifth side, the fifth side extending linearly from the fourth side to a sixth side, the sixth side extending linearly from the fifth side to the first side, the fourth side being opposite and parallel to the first side, the first side having a notch defined therein and the fourth side having a notch defined therein, the notch of the first side and the notch of the fourth side being in communication with the central opening.

20. The communication system of claim 19, wherein the ring resonators are backed by a metallic sheet and the artificial ground is an anisotropic artificial ground.

* * * * *